US012479019B2

(12) United States Patent
Dunn

(10) Patent No.: US 12,479,019 B2
(45) **Date of Patent: *Nov. 25, 2025**

(54) BENDING MANDRIL COMPRISING ULTRA HIGH MOLECULAR WEIGHT MATERIAL, RELATED BENDING MACHINES, SYSTEMS, AND METHODS

(71) Applicant: Manufacturing Resources International, Inc., Alpharetta, GA (US)

(72) Inventor: William Dunn, Alpharetta, GA (US)

(73) Assignee: Manufacturing Resources International, Inc., Alpharetta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/233,912

(22) Filed: Jun. 10, 2025

(65) Prior Publication Data

US 2025/0303457 A1 Oct. 2, 2025

Related U.S. Application Data

(63) Continuation of application No. 18/397,755, filed on Dec. 27, 2023, now Pat. No. 12,350,730.

(51) Int. Cl.
*B21D 9/04* (2006.01)
*B21D 9/05* (2006.01)

(52) U.S. Cl.
CPC *B21D 9/04* (2013.01); *B21D 9/05* (2013.01)

(58) Field of Classification Search
CPC ... B21D 9/01; B21D 9/03; B21D 9/04; B21D 9/05
See application file for complete search history.

(56) References Cited

U.S. PATENT DOCUMENTS 5,074,092 A * 12/1991 Norlander ..... B32B 21/13 52/847
7,131,313 B2 * 11/2006 Nakazato ..... B21D 9/073 72/149
11,668,695 B1 * 6/2023 Bolton ..... G01N 29/07 73/32 A
2022/0161309 A1 * 5/2022 Gambino ..... B21D 9/05

* cited by examiner

*Primary Examiner* — Teresa M Ekiert
(74) *Attorney, Agent, or Firm* — Standley Law Group LLP; Jeffrey S. Standley; Adam J. Smith

(57) ABSTRACT

Bending mandrils and related bending machines and methods are disclosed, which include at least one ultra-high molecular weight (UHMW) material. The mandril, which may comprise or consist of the UHMW material, is placed within an interior of a structure to be bent before the structure is bent about a bending die of the bending machine. Kerf cuts may be provided at the mandril for added flexibility. Other components of the bending machine, such as the following block and/or the bending die may also include panels of surfaces comprising a same or different UHMW material.

17 Claims, 7 Drawing Sheets

BENDING MANDRIL COMPRISING ULTRA HIGH MOLECULAR WEIGHT MATERIAL, RELATED BENDING MACHINES, SYSTEMS, AND METHODS

CROSS-REFERENCE TO RELATED APPLICATIONS

This application is a continuation of U.S. application Ser. No. 18/397,755 filed Dec. 27, 2023, the disclosures of which are hereby incorporated by reference as if fully restated herein.

TECHNICAL FIELD

Exemplary embodiments relate generally to bending mandrils comprising ultra-high molecular weight (UHMW) material(s) as well as related bending machines, systems, and methods.

BACKGROUND AND SUMMARY OF THE INVENTION

Bending machines are known. These machines are used to bend relatively strong material, such as one or more metals, metal alloys, or the like. Where it is desired to bend a hollow structure, such as a tube, it is known to employ mandrils. Typically, a mandril is inserted within the hollow structure to preserve its shape (e.g., prevent it from collapsing) while the structure is bent. Conventionally, these mandrils consist of metal structures which are linked together in a fashion which provides a level of flexibility. However, metal can scratch the structure and/or be overly rigid, resulting in damage to the structure, such as cracking. This is particularly true of relatively large, relatively thin walled, and/or relatively cuboidal structures (i.e., those having a substantially square or rectangular cross section). Alternatively, or additionally, this is particularly true of certain materials such as aluminum or certain aluminum alloys. What is needed is an improved mandril for bending structures.

A bending mandril comprising UHMW material is provided along with related bending machines, systems, and methods. The bending mandril may comprise or consist of one or more UHMW materials. Preferably, the UHMW material is a polymer, such as but not limited to UHMW polyethylene.

In exemplary embodiments, without limitation, the bending mandril is formed into an elongate, generally cuboidal shape to match or substantially match (e.g., fill at least 80% of) the interior shape of an interior space of a structure to be bent. Preferably, kerf cuts are provided in at least one surface of the mandril to increase flexibility for bending with the structure during the bending process. In other exemplary embodiments, without limitation, the mandril may comprise multiple segments, each comprising, substantially comprising (e.g., making up at least 80% of the material by wight), or consisting of, UHMW material, which are joined together flexibly, such as by way of a cable or other flexible line, hinged linkage, combinations thereof, or the like.

The bending mandril may be located at a distal portion of a mandril rod of a bending machine. The bending mandril may be inserted into a structure to be bent prior to bending. After bending, the bending mandril may be removed from the structure. In exemplary embodiments, without limitation, the same or a different UHMW materials may be provided at panels of the bending machine that contact the structure for bending, such as to reduce or eliminate scratching, marring, or other types of damage.

Further features and advantages of the systems and methods disclosed herein, as well as the structure and operation of various aspects of the present disclosure, are described in detail below with reference to the accompanying figures.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical, similar, or equivalent features, and wherein.

DETAILED DESCRIPTION OF EXEMPLARY EMBODIMENT(S)

Figure 1:
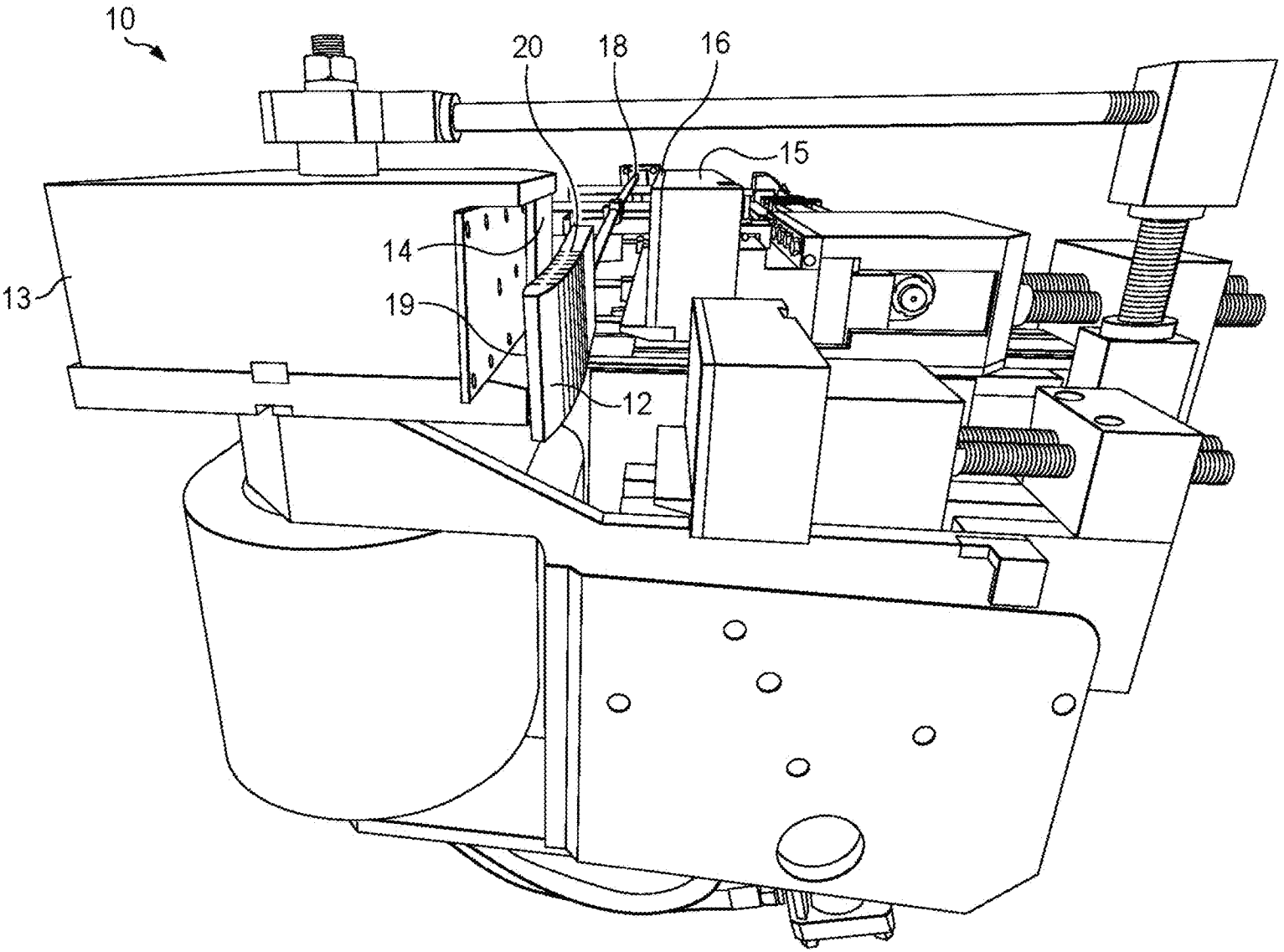
FIG. 1 is a rear, detailed perspective view of an exemplary bending machine with exemplary UHMW mandril.
Figure 2:
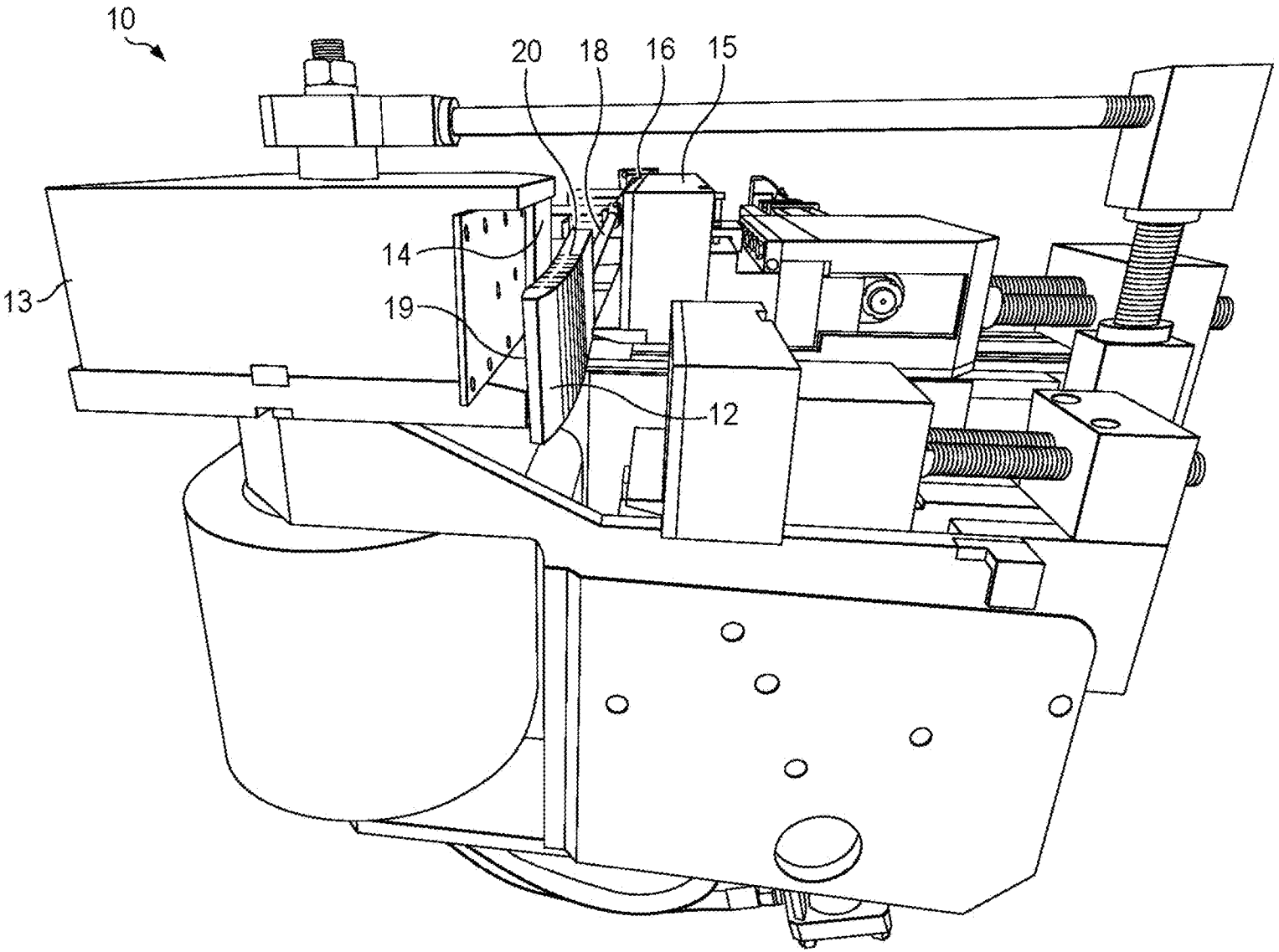
FIG. 2 is another rear perspective view of the bending machine of FIG. 1.
Figure 3:
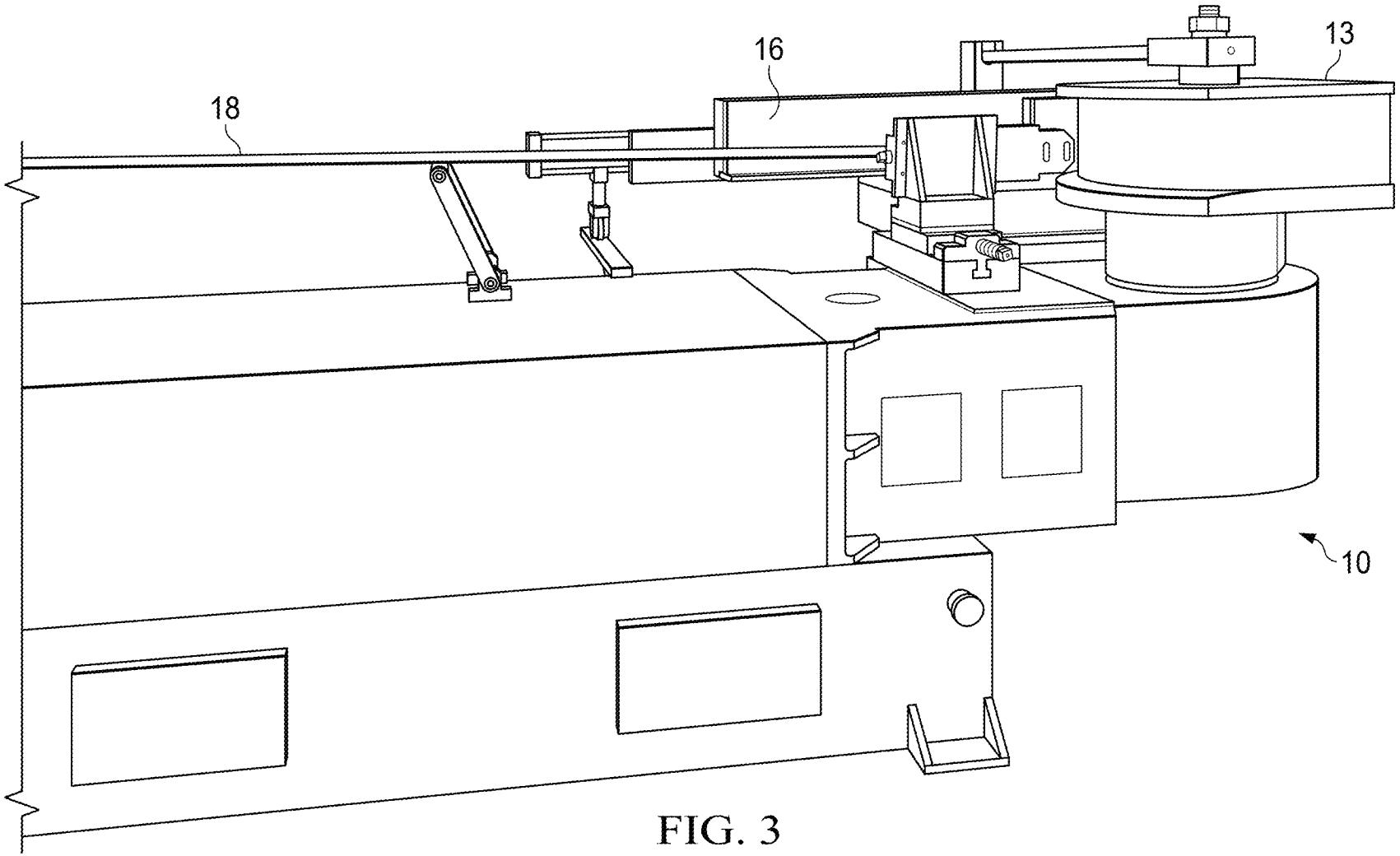
FIG. 3 is a side view of the bending machine of FIG. 1.
Figure 4:
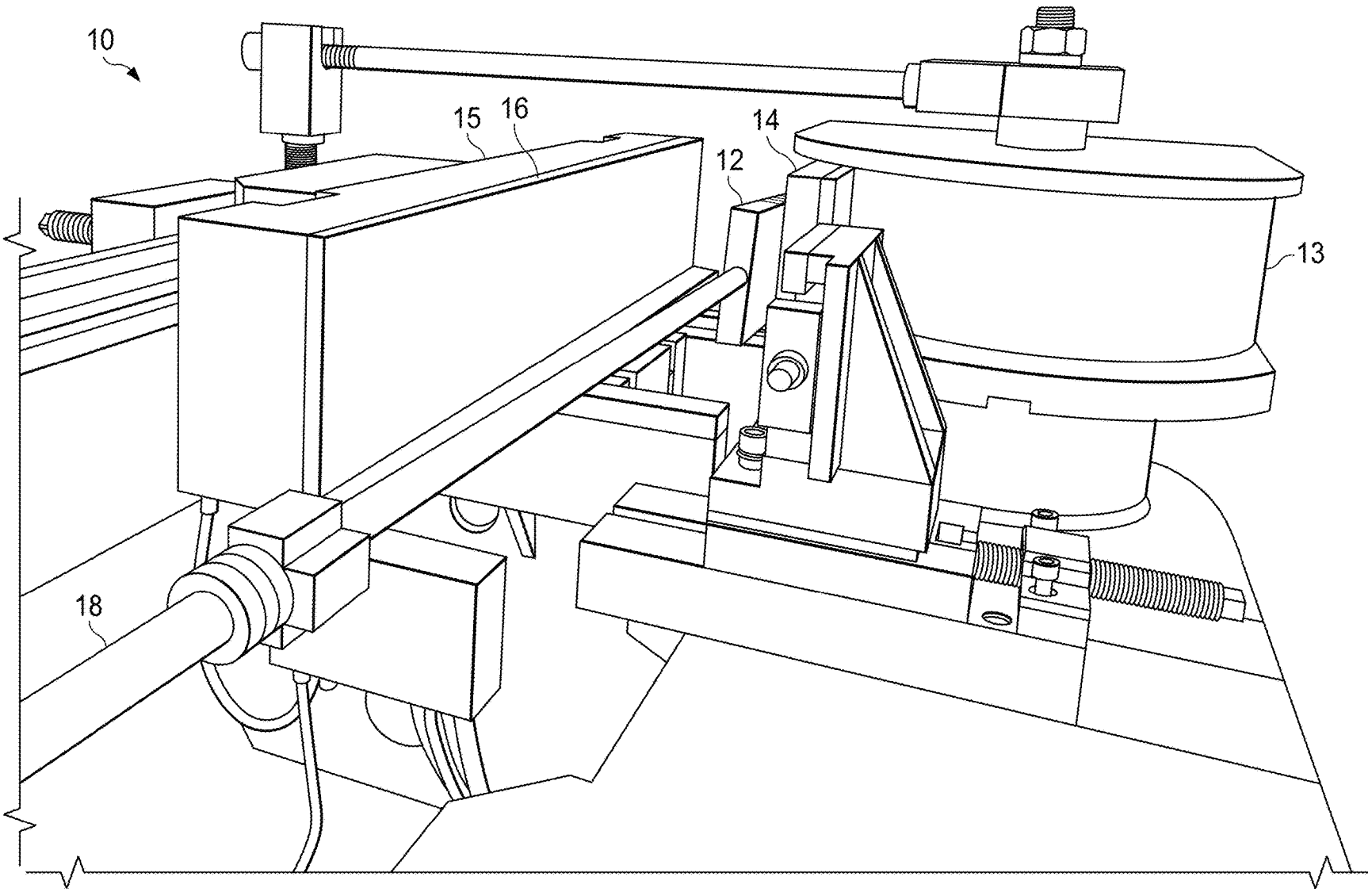
FIG. 4 is a front, detailed perspective view of the bending machine and UHMW mandril of FIG. 1.

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Embodiments of the invention are described herein with reference to illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

FIG. 1 through FIG. 4 illustrate an exemplary bending machine 10 with an exemplary UHMW mandril 12. The bending machine 10 in exemplary embodiments, without limitation, may include the HINES® bending systems, such as but not limited to the 600NC Model, available from Hines Bending Systems Inc. of Fort Meyers, FL (https://hinesbending.com). However, as those of skill in the art will recognize, these disclosures, including but not limited to the UHMW mandrils 12, may be used with a wide variety of types and kinds of bending machines 10 from a wide variety of providers of such bending machines 10. These disclosures are not intended to be limited to use with any particular make or model of bending machine 10.

The bending machine 10 may comprise conventional bending machine components, such as but not necessarily limited to, one or more fixed objects (e.g., follower block 15, clamp blocks, wiper dies, combinations thereof, or the like), mandril rods 18, bending dies 13, control panels, and the like.

The bending mandril 12 may comprise, substantially comprise (e.g., make up at least 80% of the material by weight), or consist of one or more UHMW materials. Preferably, the UHMW material is a polymer, such as but not limited to UHMW polyethylene. A wide variety of types and kinds of UHMW material may be utilized.

In exemplary embodiments, without limitation, the bending mandril 12 is formed into an elongate shape, such as a generally cuboidal shape. The bending mandril 12 may be sized and/or shaped to match, or to substantially match (e.g., fill at least 80% of), an interior shape of a structure to be bent. The use of UHMW material may provide sufficient flexibility for bending with the structure. In other exemplary embodiments, without limitation, kerf cuts 20 are provided in at least one surface of the mandril 12, such as a surface facing the follower block 15, to provide the bending mandril 12 with greater flexibility. Kerf cuts 20 may be provided on multiple surfaces, such as the surface facing the follower block 15 and a surface facing the bending die 13 by way of non-limiting example.

The bending mandril 12 may be located at a distal portion of a mandril rod 18 of a bending machine 10. The bending mandril 12 may be inserted into a structure to be bent prior to bending. After bending, the bending mandril 12 may be removed from the structure.

Certain additional components of the bending machine 10, such as but not necessarily limited to those which contact the structure for bending, may be provided with, comprise, substantially comprise (e.g., make up at least 80% by weight of), or consist of a same or different UHMW material. This may reduce or eliminate scratching, marring, or other types of damage to the structure during bending and/or otherwise improve performance of the mandril 12. In exemplary embodiments, without limitation, such panels may comprise a first panel 14 provided at the bending die 13 and a second panel 16 provided at the follower block 15. The first and second panels 14, 16 may be provided at existing surfaces such that the panels are separable components which are attached to the bending machine (e.g., by one or more fasteners) and/or permanently affixed (e.g., adhesive) components, or may be integrally formed with the machine 10.

A forward portion 19 of the bending mandril 12 may optionally comprise one or more tapered edges, such as but not limited to formed into a point and/or generally pyramidal shape. This may assist with insertion of the mandril 12 into the structure.

Figure 5:
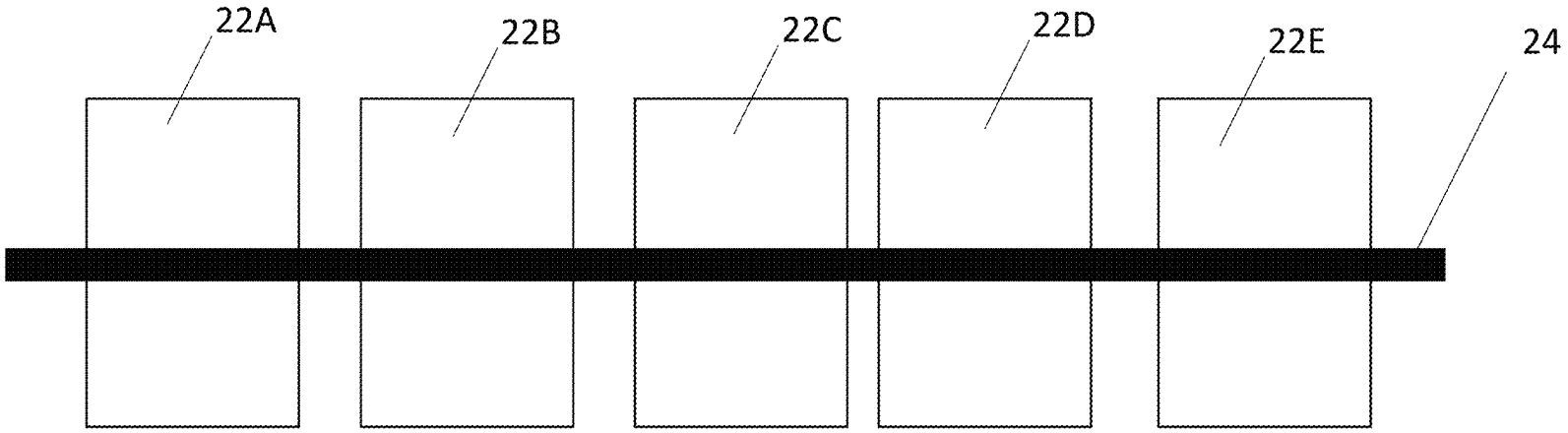
FIG. 5 is a side view of another exemplary UHMW mandril.
Figure 6:
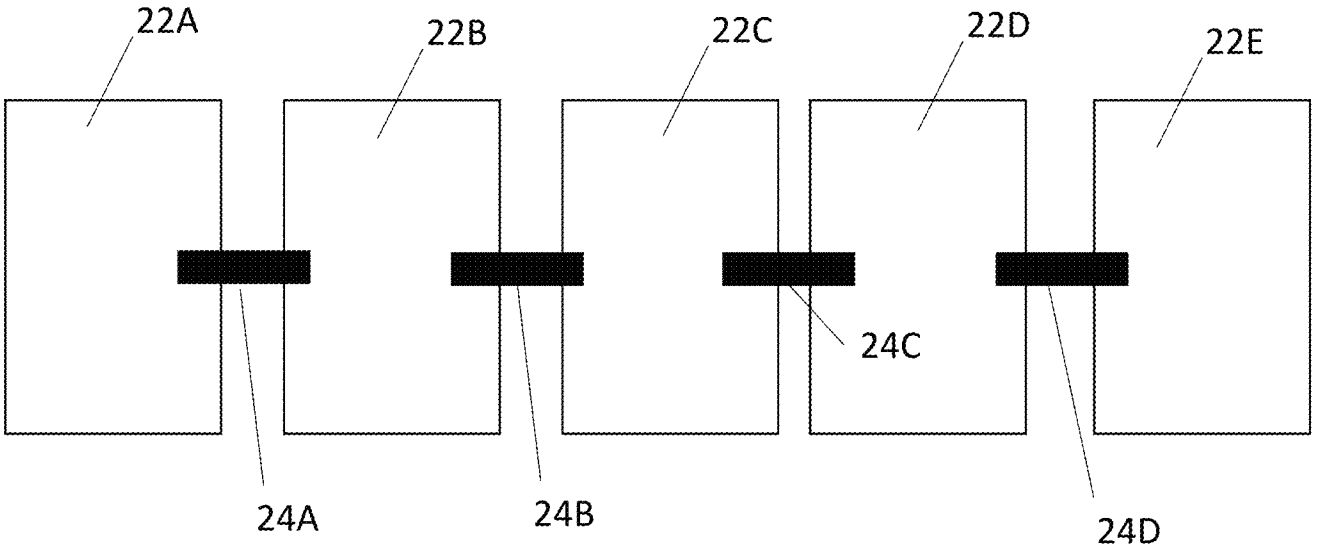
FIG. 6 is a side view of another exemplary UHMW mandril.

In other exemplary embodiments, such as illustrated in FIG. 5 and FIG. 6 by way of non-limiting example, the mandril 12 may comprise multiple segments 22A, 22B, 22C, 22D, 22E, etc. Varying number, size, and shape segments 22 may be utilized. Each of the segments 22 may comprise, substantially comprise (e.g., make up at least 80% by weight of), or consist of UHMW material. The segments 22 may be joined together one or more linkages 24 to provide such flexibility during bending. The linkage 24 may comprise one or more cables or other flexible line, hinged structures or other hinging members or components, combinations thereof, or the like. In such embodiments, the linkage(s) 24 may comprise or consist of UHMW materials or another material, such a plastic, metal, combinations thereof, or the like. The linkage(s) 24 may extend through each or multiple of the segments 22 (e.g., FIG. 5), along one or more exterior surfaces thereof, between each of the segments 22 (e.g., FIG. 6), combinations thereof, or the like.

Figure 7:
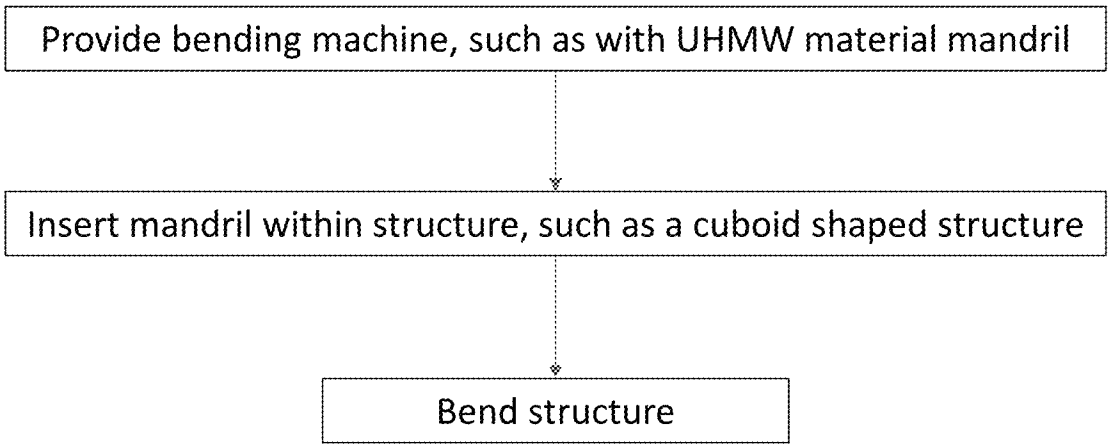
FIG. 7 is a flow chat providing an exemplary method of using the bending machine of FIG. 1.

With particular regard to FIG. 7, the mandril 12 may be inserted into a structure to be bent using the machine 10. In exemplary embodiments, without limitation, the structure is one where, at least the portion to be bent, has a generally cuboid shape and/or square or rectangular cross section. Alternatively, or additionally, the structure may comprise, substantially comprise (e.g., at least 80%), or consist of aluminum or certain aluminum alloys. The UHMW mandril 12 may be particularly well suited to reducing damages to such structures, such as from engagement with the structures, bending, combinations thereof, or the like. The structure may be positioned at the machine 10, such as between the first and second panels 14, 16, when utilized, but regardless between the bending die 13 and the follower block 15. The machine 10 may be activated for bending the structure about the bending die 13. The mandril 12 may be removed from the bent structure.

The bending machine 10, including but not limited to movement of the mandril 12, may be electronically controlled and/or motorized, though such is not necessarily required.

Any embodiment of the present invention may include any of the features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention.

Certain operations described herein may be performed by one or more electronic devices. Each electronic device may comprise one or more processors, electronic storage devices, executable software instructions, combinations thereof, and the like configured to perform the operations described herein. The electronic devices may be general purpose computers or specialized computing devices. The electronic devices may comprise personal computers, smartphones, tablets, databases, servers, or the like. The electronic connections and transmissions described herein may be accomplished by one or more wired or wireless connectively components (e.g., routers, modems, ethernet cables, fiber optic cable, telephone cables, signal repeaters, and the like) and/or networks (e.g., internets, intranets, cellular networks, the world wide web, local area networks, and the like). The computerized hardware, software, components, systems, steps, methods, and/or processes described herein may serve to improve the speed of the computerized hardware, software, systems, steps, methods, and/or processes described herein. The electronic devices, including but not necessarily limited to the electronic storage devices, databases, controllers, or the like, may comprise and/or be configured to hold, solely non-transitory signals.

What is claimed is:

1. A method of bending a hollow structure, said method comprising:

inserting a bending mandril of, or connected to, a bending machine into an interior of the hollow structure; and while the bending mandril remains within the interior of the hollow structure, operating the bending machine to bend the hollow structure;

wherein the bending mandril comprises a body comprising an ultra-high molecular weight (UHMW) material and is shaped to fit within the interior of the hollow structure;

wherein the bending mandril comprises kerf cuts spaced apart along a longitudinally extending surface of the body, said kerf cuts extending lateral relative to a longitudinal axis of the surface and extending part way, depth-wise, from the surface into an underlying portion of the body.

2. The method of claim 1 wherein:

the body of the bending mandril has a cross sectional shape configured to at least substantially match a cross sectional shape of the interior of the hollow structure.

3. The method of claim 2 wherein:

the cross sectional shape of the bending mandril and the interior of the hollow structure is square or rectangular.

4. The method of claim 3 wherein:

the body of the bending mandril is cuboid shaped and the interior of the hollow structure is cuboid shaped.

5. The method of claim 1 wherein:

the kerf cuts are provided only at the surface.

6. The method of claim 1 wherein:

the hollow structure comprises metal.

7. The method of claim 1 wherein:

the body of the bending mandril is at least substantially comprised of the UHMW material.

8. The method of claim 7 wherein:

the body of the bending mandril consists of the UHMW material.

9. The method of claim 1 wherein:

the body comprises distinct sections joined by a common flexible line.

10. The method of claim 1 wherein:

the body comprises distinct sections, each adjacent pair of which is joined by a distinct, flexible line segment.

11. The method of claim 1 wherein:

the body comprises distinct sections, each adjacent pair of which is joined by a respective hinge.

12. The method of claim 1 wherein:

a forward portion of the body comprises one or more tapered edges.

13. The method of claim 12 wherein:

the forward portion of the body comprises a pyramidal shape.

14. The method of claim 1 wherein:

a bent portion of the hollow structure is bent into a smooth curve along a longitudinal axis thereof.

15. A bending machine comprising:

a bending die;

a follower block;

a mandril rod; and a bending mandril comprising:

a body comprising an ultra-high molecular weight (UHMW) material and shaped to fit within an interior of a hollow structure; and kerf cuts spaced apart along a longitudinally extending surface of the body, said kerf cuts extending lateral relative to a longitudinal axis of the surface, where said kerf cuts extend part way, depth-wise, from the surface into an underlying portion of the body.

16. The bending machine of claim 15 wherein:

the bending mandril comprises a single block which is at least substantially comprised of the UHMW material.

17. The bending machine of claim 15 wherein:

the bending die comprises a first panel attached to an exterior surface thereof at least substantially comprised of the UHMW material; and the follower block comprises a second panel attached to an exterior surface thereof at least substantially comprised of the UHMW material.

* * * * *